US005586413A

United States Patent [19]

Sharon

[11] Patent Number: 5,586,413

[45] Date of Patent: Dec. 24, 1996

[54] SELF ON CENTER LEVELING POT HANGER

[76] Inventor: Arie N. Sharon, 1322 N. Park Dr., Richardson, Tex. 75081

[21] Appl. No.: 955,414

[22] Filed: Oct. 2, 1992

[51] Int. Cl.[6] ..... A01G 9/02; A47G 7/02

[52] U.S. Cl. ..... 47/67; 248/303; 248/318; 211/119

[58] Field of Search ..... 47/67; 248/303, 248/305, 210, 214, 318, 339, 340, 341; 211/119, 116

[56] References Cited

U.S. PATENT DOCUMENTS

| | | | |
|---|---|---|---|
| 365,555 | 6/1887 | Tolman | 47/67 |
| 2,108,678 | 2/1938 | Kulhawy | 248/303 |
| 2,399,498 | 4/1946 | Messick | 47/67 |
| 2,464,665 | 3/1949 | Anderson | 47/67 |
| 2,637,518 | 5/1953 | Young | 47/67 |
| 3,332,653 | 7/1967 | Hoelzel | 248/210 |
| 4,603,507 | 8/1986 | Nelson | 47/67 |
| 4,943,025 | 7/1990 | Warner | 248/318 |

FOREIGN PATENT DOCUMENTS

| | | | |
|---|---|---|---|
| 0496370 | 6/1977 | Australia | 47/67 |
| 962656 | 4/1957 | Germany | 248/318 |
| 2514333 | 10/1976 | Germany | 248/318 |
| 961081 | 6/1964 | United Kingdom | 248/318 |

*Primary Examiner*—Ramon S. Britts
*Assistant Examiner*—Joanne C. Downs
*Attorney, Agent, or Firm*—Warren H. Kintzinger

[57] ABSTRACT

A hanger for plant pots having an upper hanger hook, a downward interim depending portion with a section laterally displaced from a vertical line from the hanger hook through the area of the center of gravity of a flower pot. The laterally displaced section is so displaced as to be clear of contact with the flower pot supported by a semi ring bottom continuation of an inwardly directed connection section from the laterally displaced section. The hanger may be provided at the upper end with a hanger extension for hanging therefrom various display items with the semi ring bottom acting as a support for the assembly on a supporting surface. In an inverted version of the flower pot device an end extension thereof is shaped for insertion in and support by earth. Another embodiment is formed from a metal tube with a support rope passed therethrough whereby the suspension height of the device is adjustable by the rope being held in a groove in the lower end of the tube.

3 Claims, 3 Drawing Sheets

SELF ON CENTER LEVELING POT HANGER

Figure 1:
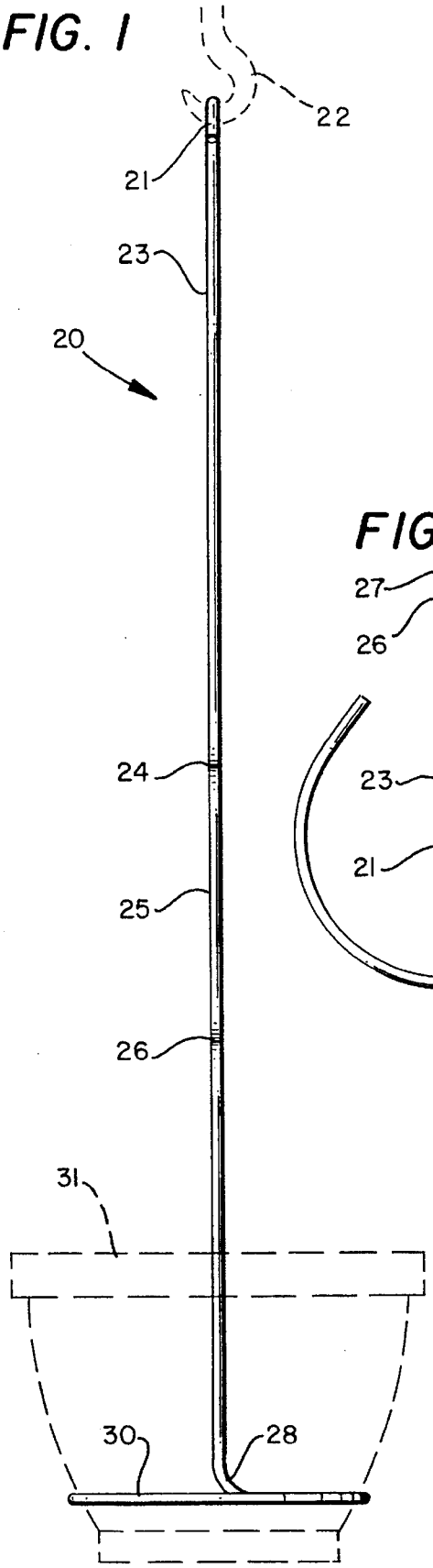

This invention relates in general to flower pot supporting devices and systems, and in particular, to a self on center gravity force leveling plant pot hanger.

Many plant pot supporting systems are multi-piece devices, complex and expensive. Some have structural sections in the path of water containers being used for plant watering and many are quite limited in the specific size of the plant pot they can support. Safety is also a consideration with respect to those using the plant pot support and also minimizing plant pot damage.

It is therefore a principal object of this invention to provide a plant pot support simple in design and aesthetically attractive to the eye.

Another object is to provide such a plant pot support with self leveling of the plant pot.

A further object is to provide such a plant pot support with a section near the pot formed to clear the pot and minimize interference with watering of plants within the pot.

Still another object is to provide a plant pot support safe to use.

Features of the invention useful in accomplishing the above objects include, in a self pot centering and pot self leveling hanger a hanger for plant pots having an upper hanger hook a downward interim deending portion with a section laterally displaced from a vertical line from the hanger hook through the area of the center of gravity of a flower pot. The laterally displaced section is so displaced as to be clear of contact with the flower pot supported by a semi ring bottom continuation of an inwardly directed connection section from the laterally displaced section. The hanger may be provided at the upper end a hanger extension for hanging therefrom various display items with the semi ring bottom acting as a support for the assembly on a supporting surface. In an inverted version of the flower pot device an end extension thereof is shaped for insertion in and support by earth. Another embodiment is formed from a metal tube with a support rope passed therethrough whereby the suspension height of the device is adjustable by the rope being held in a groove in the lower end of the tube.

Specific embodiments representing what are presently regarded as the best modes of carrying out the invention are illustrated in the accompany drawings.

Figure 2:
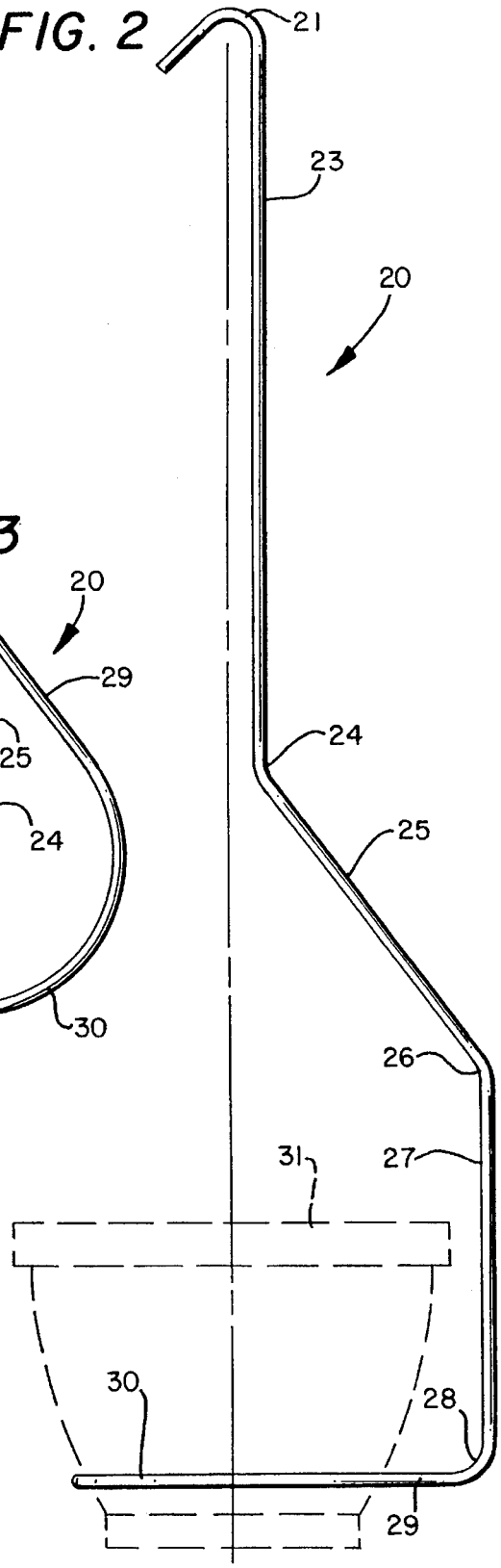
Figure 3:
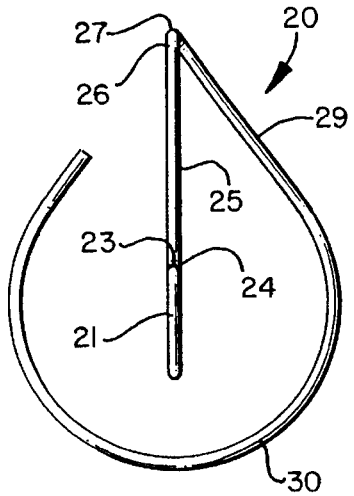
Figure 7:
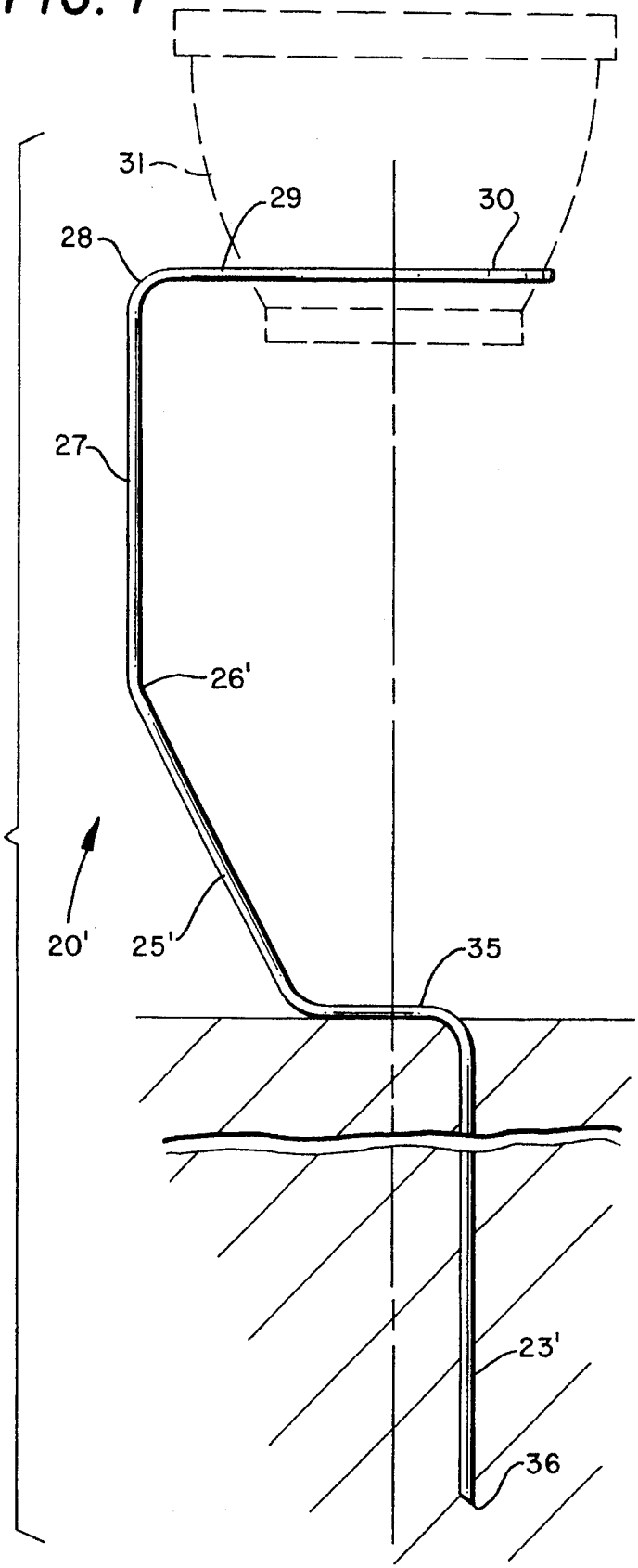
Figure 4:
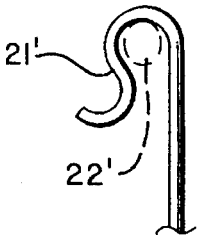
Figure 5:
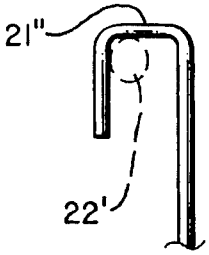
Figure 6:
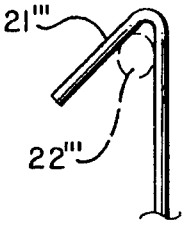
Figure 8:
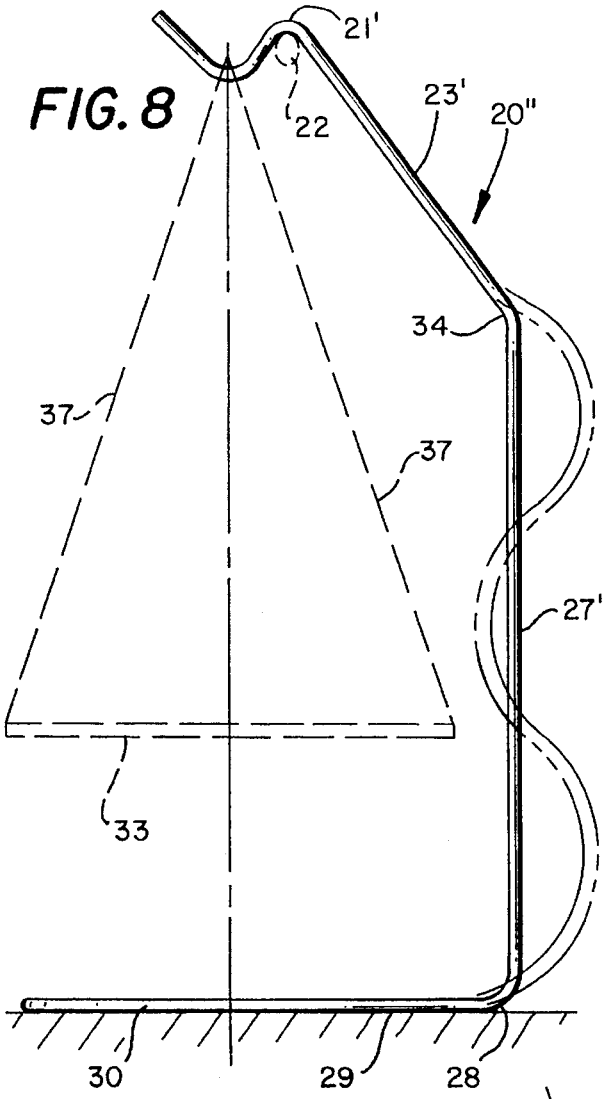
Figure 10:
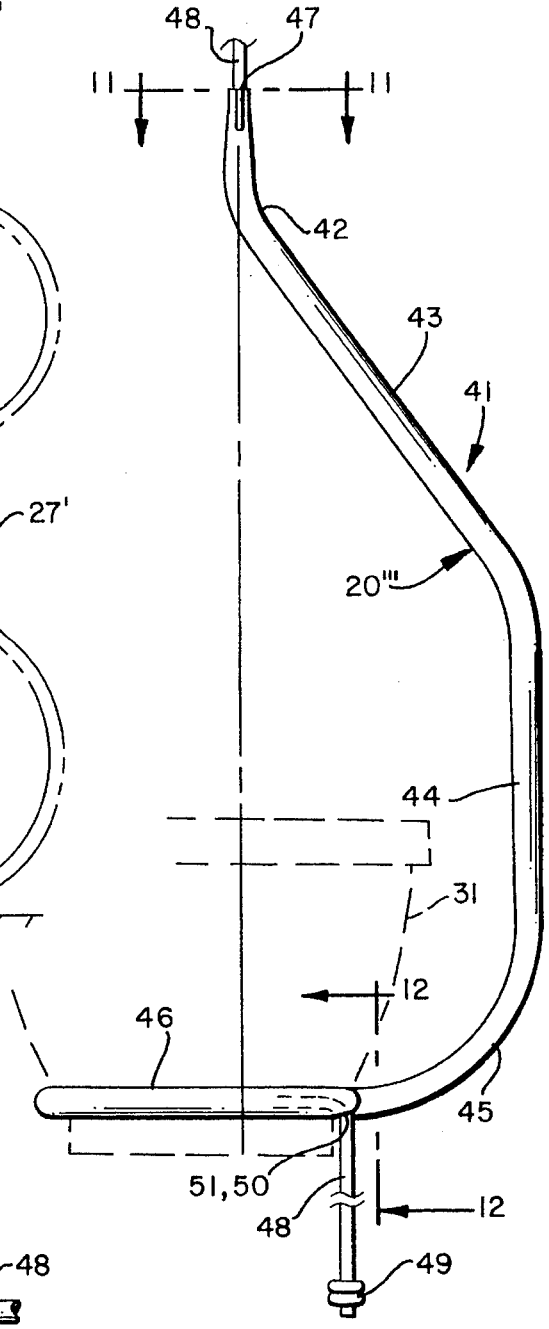
Figure 9:
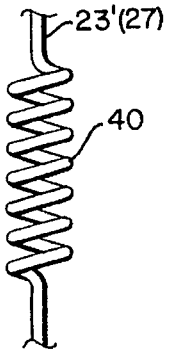
Figure 11:
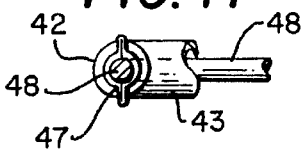
Figure 12:
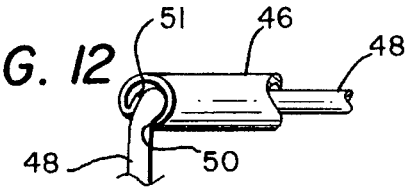

In the drawings:

FIG. 1 represents a front elevation view of a one piece wire pot hanger from a top hanger end down to a plant pot encircling holding bottom end;

FIG. 2, a side elevation view of the one piece wire pot hanger of FIG. 1;

FIG. 3, a top plan view of the one piece wire pot hanger of FIGS. 1 and 2;

FIGS. 4, 5 and 6, different top wire end configurations from that of FIG. 1 for engaging a supporting hook;

FIG. 7, a one piece wire pot support inverted from the hanger of FIGS. 1, 2 and 3, with the bottom end stuck in the ground;

FIG. 8, a one piece wire pot hanger like that of FIGS. 1–3 but with different uses and shape variations;

FIG. 9, a coil like wire shape that may be included in sections of the one piece wire plant pot holder of FIGS. 1–3;

FIG. 10, a side elevation view of a tubular pot hanger with a supporting cope (or wire) extended therethrough from a suspension section at the top to a length adjustment section at the bottom;

FIG. 11, tube top rope entrance end detail of the FIG. 10 embodiment; and, FIG. 12, tube bottom rope height adjustment gripping end detail.

Referring to the drawings:

In the drawings:

The one piece wire pot hanger 20 of FIGS. 1–3 is shown to have a top formed over hanger end 21 that is supported by hanger hook 22, shown in phantom. A vertical hanging section 23 extends from the hanger end 21 downward generally parallel to a center of gravity projection line to bend 24 to outwardly and downwardly extended section 25. Section 25 extends outwardly far enough to bend 26 connected to vertical extended section 27 for it to be laterally displaced sufficiently to clear the rim of pot 31 by a space so as to not affect placement of pot 31 in the circular portion 30 of the pot hanger 20. In fact with pots 31 having curvilinear or sloped sides a range of pot 31 sizes may be accomodated by one chosen circular portion size. The bottom of vertically extended section 27 ends in bend 28 to an angled lateral extension 29 terminating in and generally tangential to the circular portion 30. The hook 21' of FIG. 4, is a variation of hook 21 designed to fit hook 22' more closely. The hook 21" can fit over a ceiling rafter or be suspended from a hook 22'. Hook 21'" of FIG. 6, is yet another variation that can be used over a hook 22'".

With the single wire plant pot support device 20' of FIG. 7 an inverted embodiment is presented with what had been a bottom circular portion 30 in the embodiment of FIGS. 1–3 now a top circular portion 30. Angled lateral extension 29, bend 28 and vertically extended section 27 are substantially the same as with the embodiment of FIGS. 1–3. Then bend 26' connects section 27 to downwardly and inwardly angled section 25' that at the bottom is bent to horizontal section 35 that in use rests on the ground. The other end of horizontal section 35 is bent to vertical section 23' that has a pointed bottom end 36 for insertion of the section 23' into the ground.

The single wire support device 20', embodiment of FIG. 8, uses the circular section 30 and angled lateral extension 29 joining section 30 and bend 28 as a base placeable on a supporting surface. Bend 28 is connected to vertical section 27', that may instead be a serpentine vertical section as shown in phantom, extending to bend 34 connected to vertical and inwardly directed section 23'. Section 23' extends to hook section 21' that may be suspended from hook 22, if device 20" is not resting on a supporting surface, and/or hook section 21' can be used to support plate 33 via suspension lines 37.

The coiled section 40 of FIG. 9, may be included in wire sections 23, 25 and/or 27, as could other wire shapes, of the FIGS. 1–3 embodiment, or in sections 27 25', 27' and/or 23' of the embodiments of FIGS. 7 and 8.

Referring now to the tubular and rope-pot hanger 20'" embodiment of FIGS. 10, 11 and 12 the tube 41 upper end section 47 is formed with a rope 48 entrance top end, extends downward through bend 42 to outwardly and downwardly extended section 43, through a bend to vertical section 44. The bottom of vertical section 44 ends in curve 45 to an angled lateral extension connection terminating in and generally tangential to the circular portion 46. This circular portion 46 terminates in rope 48 outlet opening 50 with the tube 41 slotted 51 to grip rope 48, that terminates in end knot 49, and give a height adjustment for the hanger 20'" and the plant pot 31 supported thereby. Here just as with the embodiment of FIGS. 1–3 the suspension point is at or near a vertical line extended through the center of gravity of the plant pot 31 along with the hanger'".

Whereas, this invention is herein illustrated and described with respect to specific embodiments thereof, it should be realized that various changes may be made without departing from the essential contributions to the art made by the teachings hereof.

I claim:

1. A plant pot mount comprising: a one piece wire metal member including, a circular portion sized to mount a predetermined range of plant pot sizes and to clear plants in said pots; a lateral extension outwardly from said circular portion; a vertically extended section substantially at right angles to the plane of said circular portion and extending from the outermost portion of said lateral extension so as to be laterally displaced from said circular portion sufficiently to clear a pot mounted in said circular portion and generally to clear plant foliage extending upward from said pot; an inwardly and upwardly directed slanted section connected to the top of said vertically extended section and extended inwardly to a top vertically extended mount section generally parallel and adjacent to a center line projected of the center of said circular portion; and a bent over suspension hook extended from the top of said mount section spanning the center line projection of the center of said circular portion.

2. The plant pot mount of claim 1, wherein said lateral extension is an angled lateral extension terminating in and generally tangential to said circular portion.

3. The plant pot mount of claim 2, wherein a portion of said section is coil shaped.

* * * * *